US005455134A

United States Patent [19]

Dankert

[11] Patent Number: 5,455,134

[45] Date of Patent: Oct. 3, 1995

[54] FABRICATION OF WATERLESS PLANOGRAPHIC PLATES BY LASER PRINTING AND XEROGRAPHIC METHODS

[76] Inventor: Fred Dankert, R.R. 3, Box 99, Oxford, N.Y. 13830

[21] Appl. No.: 144,363

[22] Filed: Nov. 2, 1993

[51] Int. Cl.[6] ..... G03G 13/28

[52] U.S. Cl. ..... 430/49

[58] Field of Search ..... 428/447; 101/462; 430/49

[56] References Cited

U.S. PATENT DOCUMENTS 4,179,295 12/1979 Takamizawa et al, ..... 430/49
5,139,905 8/1992 Legere-Krongauz ..... 430/49

*Primary Examiner*—John Goodrow
*Attorney, Agent, or Firm*—Salzman & Levy

[57] ABSTRACT

The present invention pertains to planographic plates fabricated with a silicone coating which produces economical and durable waterless plates, when the coating is applied to plates imaged by xerographic toner, cured and allowed to properly develop. Such a plate has a very high resolution and an excellent ink repellency in the non-print zones. The process of the invention applies the silicone coating directly onto a plate imaged by laser printing, curing the silicone and then applying a solvent (developer) which penetrates through the silicone to the image. The imaging material is removed precisely, leaving a silicone stencil only in the desired, non-print areas. The silicone coating attaches directly to the base metal (aluminum oxide), producing a very durable coating having low, free-surface energy.

19 Claims, No Drawings

FABRICATION OF WATERLESS PLANOGRAPHIC PLATES BY LASER PRINTING AND XEROGRAPHIC METHODS

FIELD OF THE INVENTION

The present invention pertains to planographic plates fabricated with a silicone coating which produces waterless plates, when the coating is applied to plates that have been imaged by xerographic and laser printing methods, cured and properly developed; and, more particularly, to a process that entails the application of a solvent, permeable silicone coating directly onto a laser- or xerographic-imaged plate; the curing of the silicone; and, then, the application of a solvent (developer) which penetrates through the silicone to the image. The imaging material is removed only from definite, precise areas, thus leaving a silicone stencil comprising the areas that are not to be printed.

BACKGROUND OF THE INVENTION

Waterless plates have been fabricated since 1970. Most current manufacturing procedures employ one or more of the following three imaging techniques:

1. A light-sensitive layer underlies the repellent silicone layer, remaining there after development in the exposed areas that become the non-image 2. The repellent silicone layer is directly attached to the support, with none of it removed in development; the image is made by attaching ink-receptive particles to the silicone, with these particles becoming the image 3. The repellent silicone layer is directly attached to the support, with none removed during development; the image is formed by altering the silicone layer by utilizing electrical discharge techniques There are many variations on the above techniques, as befitting this creative and imaginative art. In some cases, several other materials are introduced between the repellent silicone layer and the support.

The ability to produce a high-quality waterless planographic plate has heretofore proved elusive. One troublesome problem is that it is difficult for silicone coatings to adhere to organic materials. Therefore, when such materials underlay the silicone coating, poor adhesion results. Another critical situation is created when high heat over long cure cycles deteriorates organic materials, especially photosensitive ones. This makes heat post curing of the silicone layer difficult or even impossible. Another dilemma plaguing the industry is posed by the plates being easily degraded and destroyed. Still another deficiency of the existing plates is their inability to be imaged by any method other than photographic methods. This makes corrections difficult and the use of direct imaging (such as laser printing or xerography) impossible.

The present invention reflects the discovery that low, free-surface energy polymers chemically bonded to the substrate produce suitably repellent areas for the non-print zones of waterless plates. Dimethylpolysiloxanes have such properties. They can be made into tough, elastic films by catalytic reaction, after which they also possess certain reactive groups. For purposes of this invention, the film must be adherent to the non-print plate surface, usually aluminum oxide. The low, free-surface energy polymers must also be sufficiently permeable to allow a developer to pass through to the image. In turn, the developer must be capable of producing a precise image. The word "precise" in this case indicates that the demarcation between the image areas and the non-print zones must be preserved exactly as they were on the original plate.

Dimethylpolysiloxanes with terminal hydroxyl sites are suitable prepolymers, but this inventor has found that they will only provide precise, well-adherent images when they are mixed and cross-linked with dimethylpolysiloxanes having certain other, reactive terminal groups. The reactive terminal groups allow for a strong cross-linking of the polymers, so that the development of the non-print areas will be exactly preserved. A chemical linkage occurs between the polymer silane groups and the metal oxide of the substrate, resulting in a very adherent film.

SUMMARY OF THE INVENTION

The invention features a waterless planographic plate and a method for making same. The imaged plate is coated with a low, free-surface energy polymer. Certain silicones having a low surface energy have been found to be useful for this purpose. The surface energy is related to the surface tension, which is measured by determining the contact angles that typical fluids such as water, glycerine and methylene iodide make with respect to a silicone surface. The surface tension coefficients for the present invention are in the approximate range of between 10 to 12 dynes/cm for the non-image portions of the plate and in the approximate range of between 40 to 50 dynes/cm for the image areas of aluminum oxide plates.

The silicone coating of this invention can be applied by hand or machine. The plate, which has been imaged, is coated and then heated to between 300° F. and 400° F. for a period of 30 seconds to 5 minutes in order to cure the applied silicone. The plate is then covered with a solvent (developer), which penetrates the silicone exactly where the silicone covers the image, but does not affect the silicone in the non-print areas.

The image is released from the metal (metal oxide) base, along with the silicone that is disposed over the top thereof, leaving a silicone stencil in the non-print areas. The image comprises the bare metal/metal oxide. The plate is then washed with water and dried. It is now ready to print, or, for greater durability, it may be post cured in an oven at 400°–500° F. for 5 to 10 minutes. The silicone coating forms a chemical bond with the metal oxide, producing a very adherent, durable coating.

It is possible to use ordinary xerographic toner as the imaging material. This may be applied by hand, xerographic machine or laser printer. After the toner has been applied and fixed by heat to the plate, it is coated with the silicone materials of this invention and cured. The plate is then developed with solvent developer and next washed with water to rinse the solvent therefrom. The plate may also be post cured. It should be obvious to the skilled practitioner of this art that fabricating plates by xerographic and laser printing methods will provide very high resolution. Since it is possible to connect laser printers with computers, the derived waterless plates will benefit from their ease of manufacture, as well as the low costs of direct scanning and desktop publishing options.

The inventor has determined that the dimethylpolysiloxane silicone polymers have the desired properties required to produce repellent non-print areas on waterless plates. Such polymers can be made into tough, elastic films by catalytic reaction, after which they possess certain other, reactive groups. For purposes of this invention, the film must adhere to the non-print surface of the plate. The low, free-surface energy polymer must also be sufficiently permeable to allow the developer to pass through to the image. The image material must be precisely preserved. The word "precisely" in this case indicates that the demarcation between the image areas and the non-print zones must be maintained exactly as they were on the original plate. Dimethylpolysiloxanes with terminal hydroxyl sites are suitable prepolymers, but they are greatly improved for the purpose of this invention by being mixed and cross-linked, with dimethylpolysiloxanes containing terminal vinyl and/or acrylic groups. This polymer combination has an excellent adherence to a plate's non-print zones, while lending very good permeability to the developing solvent. Once the polymer combination is cured, the film is tough, elastic and resistant to both water and organic solvents.

The art of curing silicone polymers depends on a cross-linking compound which is caused to react with the polydimethylsiloxane-functional groups in the presence of a metal catalyst, usually a tin compound. The preferred cross-linker in this invention is a silicone-hydride functional silicone. The preferred catalysts are dibutyl tin diacetate and dibutyl tin dilaurate. An amino functional siloxane is employed as an accelerator.

Volatile organic acids are used for stabilizing the cross-linking and catalysis of the coating reaction. The stabilizer must have an acid number of at least 400.

Mineral spirits and/or cyclic silicone solvents are used to produce the correct coating viscosity.

One of the useful characteristics of the silicones used in this invention is the low rolling frictional surface. This low friction compares favorably with known waterless plates, which have surfaces of higher friction.

DESCRIPTION OF THE PREFERRED EMBODIMENT

Generally speaking, the invention pertains to a waterless planographic plate and the process for making same from xerographic toner. An imaged plate is coated with silicone, which can be applied by hand or machine. The coated plate is heated to between 300° F. and 400° F. for a period of 30 seconds to 5 minutes to cure the silicone. The plate is then covered with a solvent (developer), which penetrates the silicone exactly where the silicone covers the image, but does not affect the silicone in the non-print areas. The image is released from the metal (metal oxide) base, along with the silicone coating, leaving a silicone stencil in the non-print areas. The image comprises the bare metal/metal oxide. The plate is then washed with water and dried. It is now ready to print, or, for greater durability, it may be post cured in an oven at 400°–500° F. for 5 to 10 minutes.

The substrate to which the silicone coating is applied must meet certain criteria for proper adhesion and development. The coating must adhere well enough to the non-image areas that development does not occur. The coating adheres well to the aluminum oxide found on conventional commercial litho plates and especially anodized or chemically oxidized aluminum. To be assured that the image develops, the xerographic toner image should be soluble in the developers.

Curing of the coating is accomplished with heat, either with an oven, a hot plate or a handheld heat gun. When using an oven, the time needed varies, depending upon actual heat output. Typical oven cure schedules are between two and five minutes from 300°–400° F.

Once the coating is cured, the developer is applied; it is chosen from a class of solvents of high-solvent parameter and of medium polarity. N-methyl-2-pyrrolidone and butyrolactone are typical examples thereof. These are particularly good developers because they do not damage the silicone in the non-print zones. They are easily washed away with the dissolved, original image material and silicone coating, because they are water-soluble. A water wash and a subsequent drying complete the plate fabrication process.

It is possible to produce or add to an image on the original plate with marking pens, paints and pencils, as long as the marking material is not affected by the coating and will dissolve in the developer. Many different marking materials can be employed. Corrections or handmade emendations are easily made and will indeed print along with the original image. In a similar manner, deletions may also be made by removing portions of the original plate image with solvent.

This invention's unique advantage lies in the user's ability to control permeability. Another advantage herein is that, even after development, this plate is still able to be further cured to an exceedingly adherent film with no loss in ink resistance.

The general composition of this invention's plate coating is presented below:

GENERAL COMPOSITION
(All percentages are by weight)

| Percent (%) | |
|---|---|
| 5–25 | Hydroxyl methyl siloxane polymer |
| 2–12 | Vinyl and/or acrylic methyl siloxane polymer |
| 2–10 | Polysilane cross-linker |
| 1–4 | Amine functional siloxane accelerator |
| 2–8 | Metal catalyst |
| 4–10 | Acid stabilizer |
| 0–80 | Solvent - Mineral spirits and/or Decamethylcyclopentosiloxane and Octamethylcyclotetrasiloxane |

EXAMPLES

Example 1

An anodized aluminum plate was imaged with xerographic toner Xerox 9200/9400. After being fixed with heat (as is the practice in laser printing), the plate was coated with the following coating:

| Percent (%) | |
|---|---|
| 15.0 | Masil SFR 750 hydroxyl siloxane polymer |
| 7.0 | Masil SF 201 vinyl-siloxane polymer |
| 4.0 | Masil XL-1 cross-linker |
| 1.0 | Dow Corning 2-7131 accelerator |
| 4.0 | Dibutyltin diacetate |
| 7.0 | Neoheptanoic acid |
| 62.0 | Mineral spirits |

This was applied by hand and cured for 1½ minutes at 300° F. A second application of the coating was applied and cured for 1 minute at 300° F.

When the plate was cool, 2-methyl 2 pyrrolidone was poured on the plate. A cotton wiping pad was rubbed gently onto the plate surface. The xerox image and the silicone coating above it came off, but the non-print zones were unaffected. The plate was then washed in a sink with water and fan-dried. It was printed on a Rutherford proving press with waterless litho ink. It produced an excellent resolution of the original. The ink was washed up with mineral spirits and reinked. No loss of image or toning occurred. This washing and reinking was repeated 10 times. No loss of image or toning occurred. Pot life of the silicone coating was 16 hours.

Example 2

Using the imaged plate mentioned in EXAMPLE 1; coating with the following silicone coating; and developing with n-Methyl 2 pyrrolidone, the results are similar. In this case, the pot life was improved from 16 to 24 hours.

| Percent (%) | |
|---|---|
| 15.0 | Masil SFR 750 hydroxyl siloxane polymer |
| 7.0 | Masil SF201 vinyl siloxane polymer |
| 4.0 | Masil XL-1 cross-linker |
| 1.0 | Dow Corning 2-7131 accelerator |
| 4.0 | Dibutyltin dilaurate |
| 7.0 | Neoheptanoic acid |
| 62.0 | Mineral spirits |

Example 3

Conditions were the same as those in EXAMPLE 1, except that di (n-octyl) tin S, S'-bis (isooctylmercaptoacetate) is substituted for dibutyltin diacetate. The di (n-octyl) tin S, S'-bis (isooctylmercaptoacetate) is used with the same tin content level. The curing temperature was increased to 400° F. The results were the same, except that the pot life is increased to more than 10 days.

Example 4

Conditions were the same as those in EXAMPLE 1, except that Masil SF-MH is substituted for Masil XL-1. The results are the same.

Example 5

Conditions were the same as those in EXAMPLE 3, except that the coating solution was applied on a coater. (Thicker films can be obtained in this manner.) After being cured and developed in the same manner as before, the waterless plate is more durable and has greater ink resistance in non-print zones.

Example 6

An anodized aluminum plate was placed in a laser printer, which produced an image from xerographic toner. The plate was then coated with the following silicone coating:

| Percent (%) | |
|---|---|
| 15.0 | Masil SFR 750 hydroxyl siloxane polymer |
| 7.0 | Acrylic siloxane polymer |
| 4.0 | Masil XL-1 cross-linker |
| 1.0 | Dow Corning 2-7131 accelerator |
| 2.0 | Dibutyltin diacetate |
| 2.0 | Di (n-octyl) tin S, S'-bis (isooctylmercaptoacetate) |
| 7.0 | Neoheptanoic acid |

-continued

| Percent (%) | |
|---|---|
| 62.0 | Decamethylcyclopentasiloxane |

The plate was heat cured and devloped with n-methylpyrrolidone. After being washed, the plate was post cured at 450° F. for about 10 minutes. A waterless plate with high durability and resolution was thus obtained.

SUMMARY OF TESTING

Subsequent testing on other presses demonstrated that this invention produces a waterless plate equal to or better than present plates on the market in the following areas governing quality: resolution, printability, lack of toning, fineness of details and durability. Post curing produces greater durability than is available with existing waterless plates. This new invention is made from xerographic toner images, thus allowing direct interaction with computers. The new invention is easy to use, quick to make and very economical.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A method of fabricating a waterless planographic plate by xerographic technique, comprising the steps of:

a) placing a planographic aluminum base plate into a xerographic machine;

b) producing an image upon said planographic base plate, utilizing xerographic toner to form an imaged planographic plate;

c) directly coating low, free-surface energy, solvent permeable silicone polymers over said imaged planographic plate;

d) heat curing said imaged planographic plate;

e) developing said imaged planographic plate with solvent developer which solubilizes said xerographic toner to form a developed planographic plate; and f) washing and drying said developed planographic plate to remove the solubilized xerographic toner.

2. The method in accordance with claim 1, further comprising the step of:

g) post-curing said low, free-surface energy, permeable polymers disposed upon said planographic plate.

3. The method in accordance with claim 2, wherein said permeable polymers comprise cross-linked hydroxy-silicone compounds.

4. The method in accordance with claim 3, wherein said cross-linked hydroxy-silicone compounds are post-cured in an oven in a temperature range of approximately between 400°–500° F. for approximately 5 to 10 minutes.

5. The method in accordance with claim 3, wherein said cross-linked hydroxy-silicone compounds are cured in accordance with step (d) in a temperature range of approximately between 300° F. and 400° F. for a period of 30 seconds to 5 minutes.

6. The method of fabricating a waterless planographic plate in accordance with claim 1, wherein said low, free-surface energy, permeable polymers comprise cross-linked dimethylpolysiloxanes.

7. The method in accordance with claim 6, wherein said permeable polymers comprise cross-linked hydroxy-silicone compounds.

8. The method in accordance with claim 6, wherein said cross-linked dimethylpolysiloxanes comprise hydroxyl and vinyl groups.

9. The method in accordance with claim 6, wherein said cross-linked dimethylpolysiloxanes comprise hydroxyl and acrylic groups.

10. The method in accordance with claim 6, wherein said cross-linked dimethylpolysiloxanes comprise hydroxyl, vinyl and acrylic groups.

11. A method of fabricating a waterless planographic plate by a laser printing technique, comprising the steps of:

a) placing a planographic aluminum base plate into a laser printing machine;

b) producing an image upon said planographic base plate, utilizing laser printing toner to form an imaged planographic plate;

c) directly coating low, free-surface energy, solvent permeable silicone polymers over said imaged planographic plate;

d) heat curing said imaged planographic plate;

e) developing said imaged planographic plate with solvent developer that solubilizes the laser printing toner to form a developed planographic plate; and f) washing and drying said developed planographic plate to remove the solubilized laser printing toner.

12. The method in accordance with claim 11, further comprising the step of:

g) post-curing said low, free-surface energy, permeable polymers disposed upon said planographic plate.

13. The method in accordance with claim 12, wherein said permeable polymers comprise cross-linked hydroxy-silicone compounds.

14. The method in accordance with claim 13, wherein said cross-linked hydroxy-silicone compounds are post-cured in an oven in a temperature range of approximately between 400°–500° F. for approximately 5 to 10 minutes.

15. The method in accordance with claim 13, wherein said cross-linked hydroxy-silicone compounds are cured in accordance with step (d) in a temperature range of approximately between 300° F. and 400° F. for a period of 30 seconds to 5 minutes.

16. The method of fabricating a waterless planographic plate in accordance with claim 12, wherein low, free-surface energy, permeable polymers comprise cross-linked dimethylpolysiloxanes.

17. The method in accordance with claim 16, wherein said cross-linked dimethylpolysiloxanes comprise hydroxyl and vinyl groups.

18. The method in accordance with claim 16, wherein said cross-linked dimethylpolysiloxanes comprise hydroxyl and acrylic groups.

19. The method in accordance with claim 16, wherein said cross-linked dimethylpolysiloxanes comprise hydroxyl, vinyl and acrylic groups.

* * * * *